US006736607B2

(12) United States Patent
Ginies et al.

(10) Patent No.: US 6,736,607 B2
(45) Date of Patent: May 18, 2004

(54) LOW-PRESSURE GAS CIRCUIT FOR A COMPRESSOR

(75) Inventors: Pierre Ginies, Sathonay Village (FR); Alexandre Montchamp, Saint Priest (FR); Jean de Bernardi, Lyons (FR)

(73) Assignee: Danfoss Maneurop S.A., Trevoux (FR)

( * ) Notice: Subject to any disclaimer, the term of this patent is extended or adjusted under 35 U.S.C. 154(b) by 0 days.

(21) Appl. No.: 10/247,863

(22) Filed: Sep. 20, 2002

(65) Prior Publication Data

US 2003/0063986 A1 Apr. 3, 2003

(30) Foreign Application Priority Data

Sep. 28, 2001 (FR) ..... 01 12534

(51) Int. Cl.[7] ..... F04B 39/00; F04B 23/00; F04B 17/00; F01D 1/12

(52) U.S. Cl. ..... 417/312; 417/313; 417/371; 417/366; 417/902; 415/55.1; 415/55.6

(58) Field of Search ..... 417/312, 313, 417/410.5, 371, 366, 902; 415/55.1, 55.6

(56) References Cited

U.S. PATENT DOCUMENTS 4,396,359 A * 8/1983 Kropiwnicki ..... 417/312
4,564,339 A 1/1986 Nakamura et al. ..... 417/366
4,762,478 A * 8/1988 Sakurai et al. ..... 418/55.1
4,940,396 A * 7/1990 Shimizu et al. ..... 417/410.5
5,007,809 A * 4/1991 Kimura et al. ..... 417/371
5,772,411 A 6/1998 Crum et al. ..... 417/368

FOREIGN PATENT DOCUMENTS

EP 0 855 511 A2 7/1998 ..... F04C/23/00
JP 61-40472 2/1986 ..... F04C/18/02

* cited by examiner

*Primary Examiner*—Justine R. Yu
*Assistant Examiner*—Timothy P. Solak
(74) *Attorney, Agent, or Firm*—McCormick, Paulding & Huber LLP

(57) ABSTRACT

Compressor, comprising a sealed outer casing, inside which is arranged a gas compression stage driven by a motor arranged inside the outer casing. The lower part of the inner casing containing the motor is sealingly closed by a bottom, and at least one vertical chimney is arranged in the annular space formed between the outer casing and the lower casing, the chimney being arranged substantially vertically along the motor and the lower casing, and communicating in its upper part with the low-pressure zone of the compressor and, in its lower part, with the inside of the lower casing, one or more openings being made between the chimney and the bottom of the motor.

19 Claims, 9 Drawing Sheets

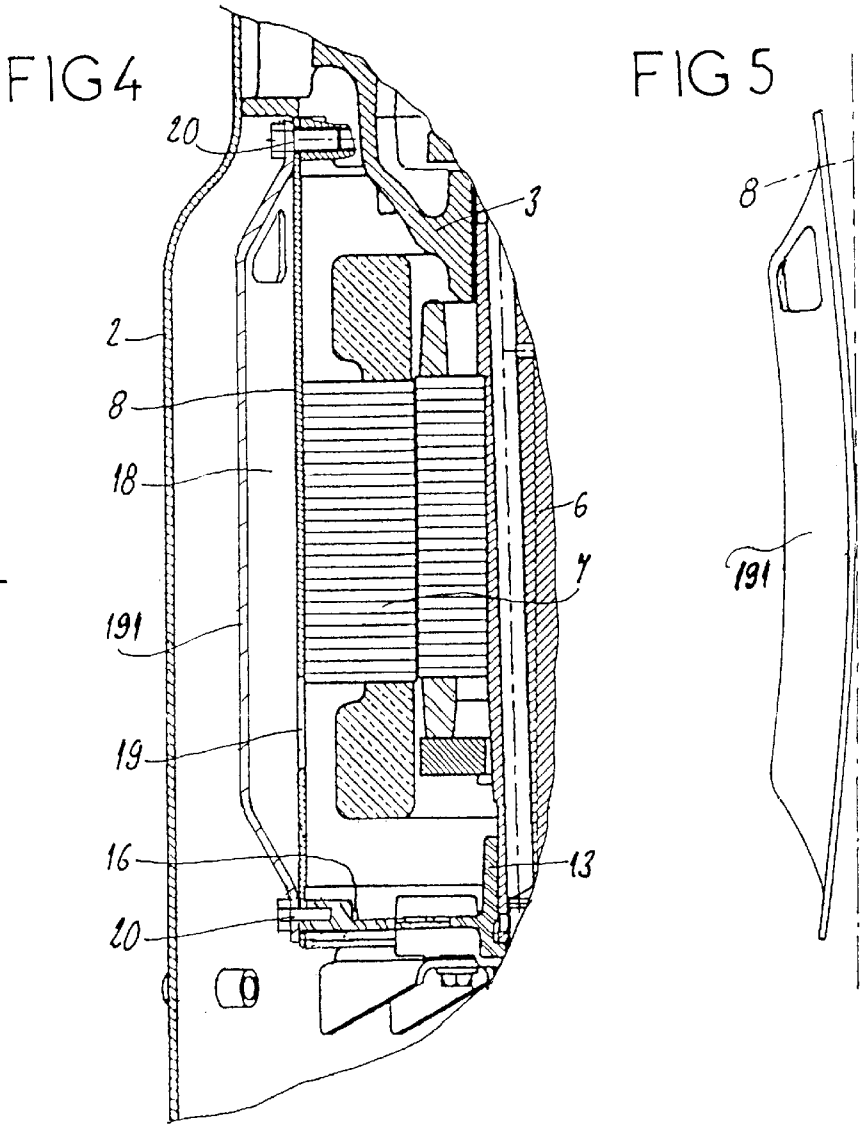
FIG 5
FIG 4
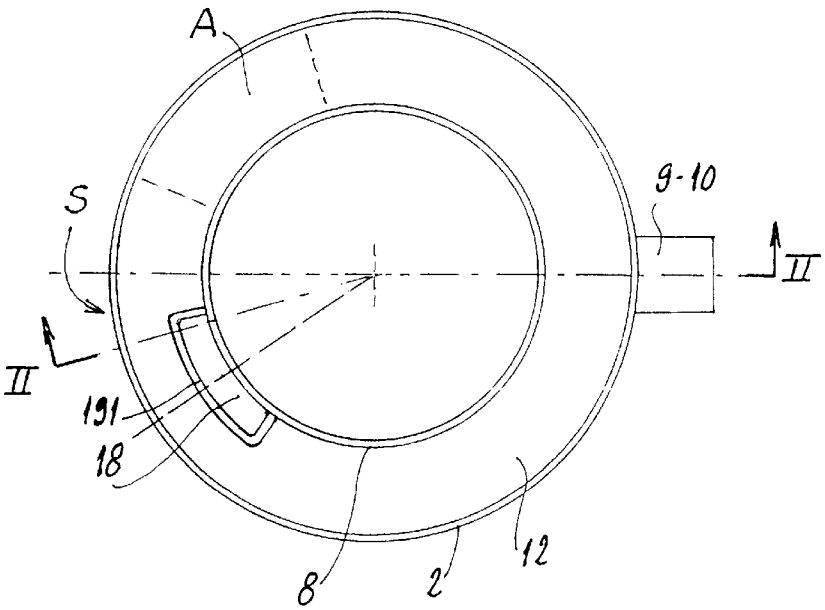
FIG 3

LOW-PRESSURE GAS CIRCUIT FOR A COMPRESSOR

CROSS-REFERENCE TO RELATED APPLICATIONS

This application is entitled to the benefit of French Patent Application No. 01.12534 filed on Sep. 28, 2001 in the name of Danfoss Maneurop S. A.

FIELD OF THE INVENTION

The subject of the present invention is a low-pressure gas circuit for a compressor, for example for a scroll-type compressor.

BACKGROUND OF THE INVENTION

A scroll-type compressor of the type to which the invention relates comprises a sealed outer casing inside which is arranged a gas compression stage, mounted on a body, comprising a fixed scroll element and a moving scroll element, the moving element being driven by a motor in an orbital motion. The motor is mounted in an inner casing arranged concentrically inside the outer casing. The outer casing has a gas intake opening and with the inner casing and the element having the fixed scroll delimits a low-pressure zone. Oil for lubricating the upper bearing leaves via openings made in the body. As is known per se, the gas drawn into the compression stage passes through the motor to cool the latter.

A compressor needs to protected against the harmful effects of the return of liquid from the plant, whether this be refrigerant in the liquid state or oil. For this purpose, certain compressors are equipped with a deflector at the gas intake orifice formed in the outer casing.

Furthermore, the gas taken in by the compressor passes in contact with the oil leaving via the openings formed in the body. This results in mixing which is not always homogenous, and which can vary between two pockets of gas taken into the compression stage.

SUMMARY OF THE INVENTION

The purpose of the invention is to provide a device for circulating gas in the low-pressure zone of the compressor which protects the latter against the transients which may bring in liquid phases returning via the intake duct, which controls the circulation of oil by separating the streams of gas and of oil or liquid, which creates no pressure drops between the connection and the reserve of oil so as not to affect the oil balancing circuit for connection in parallel, particularly with compressors of different sizes, and which reduces the noise level by filtering out the compression noises (pulsation) originating from the compression stage.

The compressor to which it relates comprises, a sealed outer casing, inside which is arranged a gas compression stage driven by a motor; the motor is arranged inside the outer casing, and is fixed under the compression stage and connected in its lower part to a sealed lower casing which may comprise a guide element for allowing the motor shaft to rotate. The outer casing has a gas inlet opening and delimiting, with the assembly consisting of the body, the motor, the lower casing and the compression system, a low-pressure zone. The compressor being of the type in which the lubricating oil used to lubricate the compression system leaves via at least one opening made in the body, and in which the gas taken into the compression stage passes through the motor to cool it.

According to the invention, the lower part of the lower casing containing the motor is sealingly closed by a bottom, and at least one chimney is arranged in the annular space formed between the outer casing and the lower casing, this chimney being arranged substantially vertically along the motor and the lower casing. The chimney communicates in its upper part with the low-pressure zone of the compressor and, in its lower part, with the inside of the lower casing. One or more openings are made between the chimney and the bottom of the motor.

The gas arriving via the intake orifice at the low-pressure zone of the compressor is directed into the upper part of the ring-shaped space so as to separate the liquid phase returning via the intake circuit. As the lower part of the motor casing and the lower bearing of the compressor form a sealed space, the gas drops down from the upper part towards the bottom of the motor by means of one or more chimneys. Then it enters the lower casing to pass through the motor and cool it before reaching the compression stage.

According to a first embodiment, the compressor, includes a sealed outer casing, inside which is arranged a gas compression stage driven by a motor, the motor delimiting an inner casing the upper part of which forms a cavity for supplying the compression stage with gas and the lower part of which forms a gas inlet cavity at the bottom of the motor, the flow of gas between the lower cavity and the upper cavity being intended to cool the motor, the outer casing comprising a gas inlet opening and delimiting, with the inner casing and the body of the compression stage, a low-pressure zone. The compressor is of the type in which the oil lubricating the upper bearing(s) and/or thrust bearing(s) leaves via at least one opening formed in the body, is characterized in that the lower part of the inner casing is sealingly closed by a bottom, and at least one chimney is arranged in the annular space formed between the outer casing and the inner casing. The chimney is arranged substantially vertically along the inner casing, and communicates in its upper part with the low-pressure zone of the compressor and in its lower part with the inside of the inner casing.

According to another embodiment, the compressor includes a sealed outer casing inside which is arranged a gas compression stage, is characterized in that the body comprises a part in the form of a tubular skirt facing downwards and to the lower end of which the motor is fixed, this skirt delimiting with the motor a cavity for supplying the compression stage with gas. The lower bearing comprises a part in the form of a tubular skirt facing upwards extending as far as the motor and delimiting therewith a lower gas inlet cavity at the bottom of the motor, the gas passing from this lower cavity towards the upper cavity, cooling the motor. The lower part of the lower casing is delimited by the skirt and the lower bearing being closed by a sealed bottom, at least one chimney being arranged substantially vertically along the skirt, the motor and the skirt, inside the outer casing, this chimney communicating in its upper part with the low-pressure zone of the compressor and in its lower part with the inside of the cavity delimited by the skirt.

The chimney communicates in its upper part with the low-pressure zone of the compressor at a location not subjected to the presence of oil.

The use of one or more chimneys allows the liquid and gaseous phases to be separated during the upwards phase of the fluid from the intake orifice towards the entry to the chimney or chimneys.

That allows the oil returning from the low-pressure circuit to be separated out and makes it possible to make sure that the control, generated by the compressor, of the circulation of oil is not connected with the amount of oil returning in sudden bursts from the circuit, as, for example, is the case when a siphon is used on the low-pressure circuit.

Depending on the origin of operation, particularly in the phases of start-up, defrosting cycle or when there is a sudden demand, there is foaming and the amount of oil in circulation increases instantaneously and takes a fairly long time to stabilize the equilibrium value.

Because, in the device according to the invention, the gas flow circuit does not cross the stream of the oil leaving the upper bearing, it does not therefore become laden with oil.

According to one feature of the invention, each chimney is angularly offset with respect to the openings of the body allowing oil to return to the reservoir delimited by the bottom of the outer casing.

It is possible to envisage orientating a chimney in the sector of 0 to 170° with respect to the plane passing through the axis of the compressor and the intake connection.

The use of at least two chimneys makes it possible to avoid the gas stream becoming laden with oil if the oil return is opposite the intake connection and between the two chimneys furthest from this connection.

According to one feature of the invention, the bottom which closes the lower casing containing the motor has at least one hole for discharging liquid to the reservoir delimited by the bottom of the outer casing.

This discharge hole allows drainage from inside the motor, avoiding, amongst other things, the washing of the lower bearing and/or of its thrust bearing as refrigerant for example migrates.

Advantageously, at least one opening made in the body and acting as a passage for the oil is extended downwards by a duct opening below the level of the intake opening of each chimney.

This arrangement avoids the constraint of orientating the chimneys with respect to the position of the openings made in the body and which are intended for the return of oil to the bottom of the outer casing. Depending on the position chosen, the length of each duct will need to vary according to its proximity to an inlet connection.

According to one embodiment of this compressor, each chimney consists of a profiled plate made of metal or synthetic material, fixed to the inner casing and delimiting a chimney with its outer surface.

The fixing may for example be afforded by screwing, using screws which serve to fix the upper and lower bearings to the motor casing.

According to another form of embodiment, each chimney consists of a profiled plate bearing, on the one hand, against the outer casing and, on the other hand, against the inner casing and delimiting a chimney therewith.

According to yet another embodiment, each chimney consists of a duct fixed to the inner casing.

In order to improve the uniformity of the gas flow rate through the motor, this compressor comprises, inside the inner casing and facing at least one opening for the conveying of gas by a chimney, a deflector for distributing the gas in the inner casing.

According to one option, each chimney is delimited on the outer casing side by a wall which has a central and longitudinal recess in which a duct for returning oil leaving the body to the oil reservoir delimited by the bottom of the outer casing is engaged on at least one chimney.

Advantageously, and so as to reduce the compression noises originating from the compression mechanism, in certain frequency ranges, at least one chimney comprises a baffle consisting, for example, of a plate or of a boss protruding inwards.

Introducing a bypass between the cavity of the low-pressure zone and locating the motor output in the upper part of the motor will make it possible to reduce pressure drops and, by the same token, to improve the efficiency of the machine.

According to another feature of the invention, the compressor comprises a chimney in the form of an annular duct enveloping the compressor drive system and placing the gases drawn in from the upper low-pressure zone of the compressor in communication with the opening or openings allowing the flow of gas to reach the lower part of the motor.

According to another feature of the invention, the compressor comprises at least one gas bypass duct between the low-pressure zone and the zone supplying the compression stage with gas.

According to another feature of the invention, the compressor comprises at least one duct for the bypassing of the gases of the low-pressure zone and the upper part of the motor.

According to a first embodiment of the invention, the compressor comprises a compression system having a moving scroll and a fixed scroll the relative motion of which is of the orbital type.

According to another embodiment of the invention, the compressor comprises a compression system which has two moving scrolls rotating about offset and parallel axes, and the relative motion of which is of the orbital type.

According to another embodiment of the invention, the compressor comprises a reciprocating-piston-type compression system.

According to yet another embodiment of the invention, the compressor comprises a rolling-piston-type compression system.

BRIED DESCRIPTION OF THE DRAWINGS

The present invention will be clearly understood from the description which follows, with reference to the appended drawing which, by way of non-limiting examples, depicts several embodiments of this compressor, in the case of a scroll-type compressor one of the scrolls of which is fixed and the other of which is moving;

FIG. 3 is a sectional view of the compressor taken along a horizontal plane;

FIG. 4 is a sectional view of part of the compressor equipped with an intake chimney;

FIG. 5 is a side view of a constituent element of an intake chimney, before fitting;

DETAILED DESCRIPTION OF THE PREFERRED EMBODIMENTS

Figure 2:
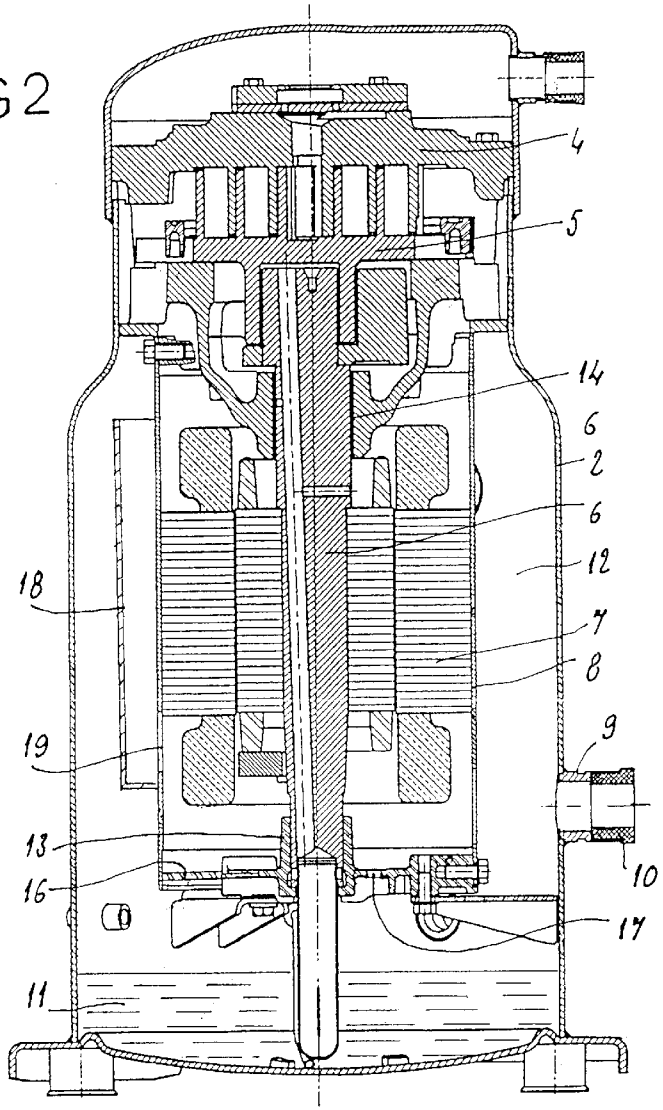
FIG. 2 is a sectional view along the line II—II of FIG. 3.
Figure 1:
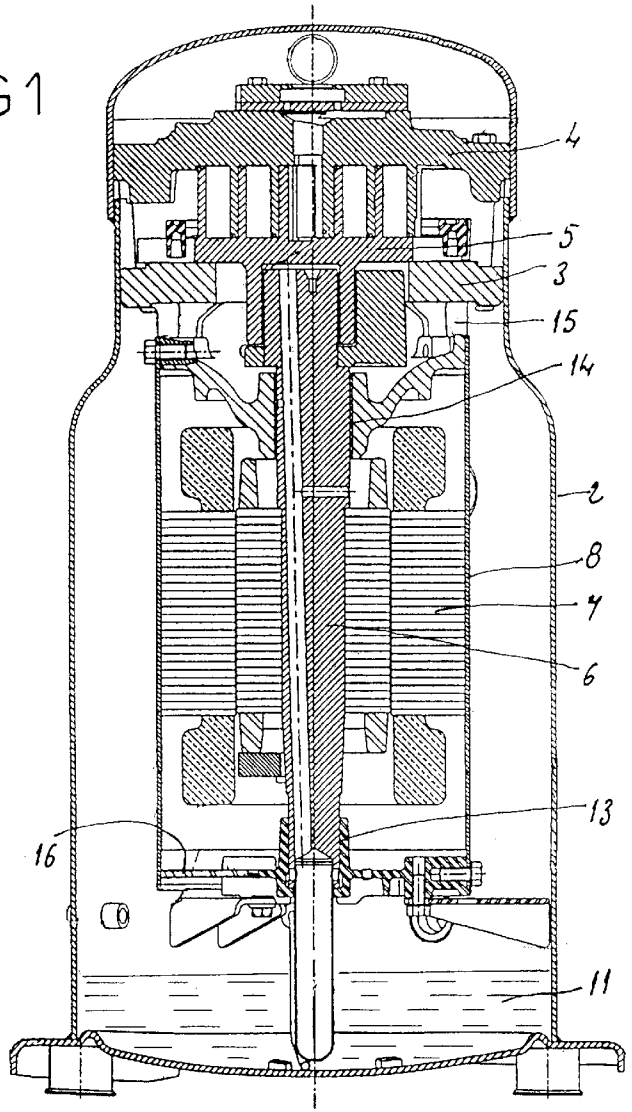
FIG. 1 is a longitudinal sectional view of a first compressor on a vertical plane containing the body-oil return orifices.

The scroll-type compressor depicted in FIGS. 1 and 2 comprises a sealed outer casing 2 inside which is arranged a gas compression stage mounted on a body 3 and comprising a fixed scroll element 4 and a moving scroll element 5. The moving element is driven by a shaft 6 from a motor 7 with an orbital motion. The motor 7 is mounted inside an inner casing 8. The outer casing comprises a gas intake opening 9 connected to the remainder of the circuit by an intake connection 10. The outer 2 and inner 8 casings delimit an annular volume 12 of the low-pressure zone of the compressor.

The compressor according to the invention comprises a lower bearing 13 and an upper bearing 14 for the shaft 6. The bearings are lubricated with oil 11 situated in the lower part of the compressor, this oil being conveyed by a canal formed inside the shaft 6. As the shaft 6 rotates, oil is discharged at the upper end of the shaft 6, this oil passing through the orifices 15 formed in the body 3, before reaching the lower part of the outer casing 2.

According to one feature of the invention, the inner casing 8 is closed off at the level of the lower bearing by a bottom 16, which sealingly closes the chamber containing the motor. At least one drain hole 17 may be provided in the bottom 16, so as to avoid the washing of the lower bearing or its thrust bearing during periods of prolonged compressor shut-down.

As shown in particular in FIGS. 2 and 3, the compressor according to the invention comprises at least one chimney 18 arranged substantially vertically along the inner casing 8, this chimney communicating in its upper part with the low-pressure annular volume of the compressor, at a location not subjected to the proximity of the oil and, in its lower part, via an opening 19, with the inside of the inner casing 8 containing the motor 7.

As shown in FIG. 3, the chimney 18 is oriented in a sector S of between 0 and 170° of the plane passing through the axis of the compressor and of the intake connection. Thus, the oil return zone denoted by the reference A in FIG. 3 is away from the point at which gas is drawn in via the chimney 18.

FIGS. 4 and 5 depict one embodiment of the chimney 18, in which embodiment this chimney consists of a profiled plate 191 cooperating with the outer face of the inner casing 8 to delimit the chimney 18, this profile 191 being curved as depicted in FIG. 5, so that it can press closely against the casing 8 after having been clamped to the body 31 and the lower bearing 13 by screws 20.

Figure 7:
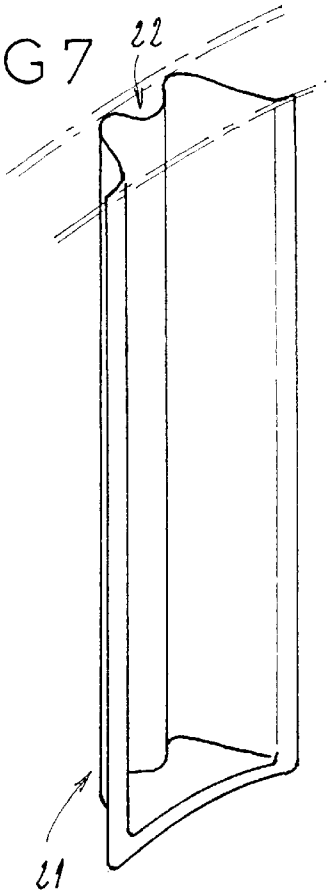
FIG. 7 is a perspective view of a constituent element of a chimney of FIG. 6.
Figure 6:
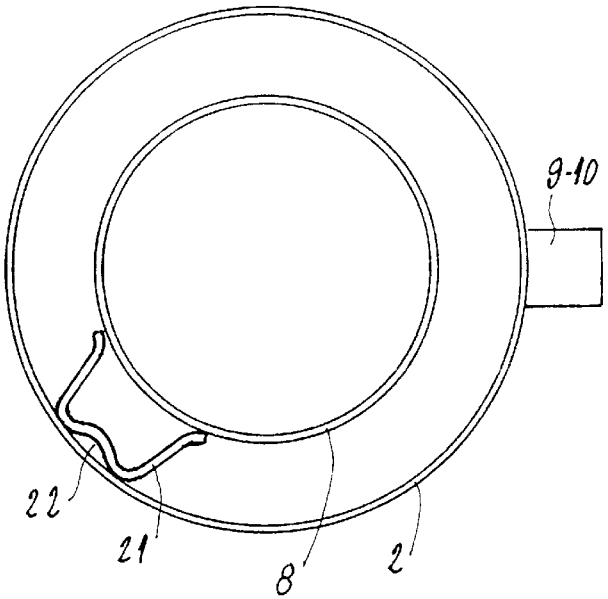
FIG. 6 is a sectional view along a horizontal plane of a compressor equipped with another chimney.

FIGS. 6 and 7 depict another profiled element 21 made of metal or synthetic material and intended to delimit a chimney 18 with the inner casing. This element 21 is wedged between the inner casing 8 and the outer casing 2 and has an outer surface which has a recess 22, affording the element a certain degree of elasticity, to encourage it to be wedged.

Figure 8:
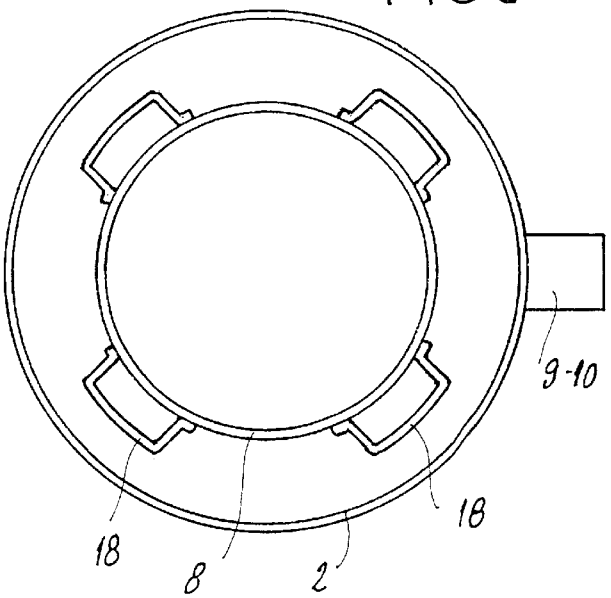
FIG. 8 is a sectional view along a horizontal plane of a compressor equipped with several intake chimneys.

FIG. 8 depicts a sectional view of a compressor having four chimneys 18.

Figure 9:
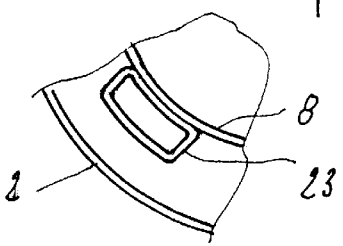
FIG. 9 is a sectional view along a horizontal plane and which is also a part section of another type of intake chimney.

FIG. 9 depicts one embodiment in which a chimney 18 consists of a complete duct 23.

Figure 11:
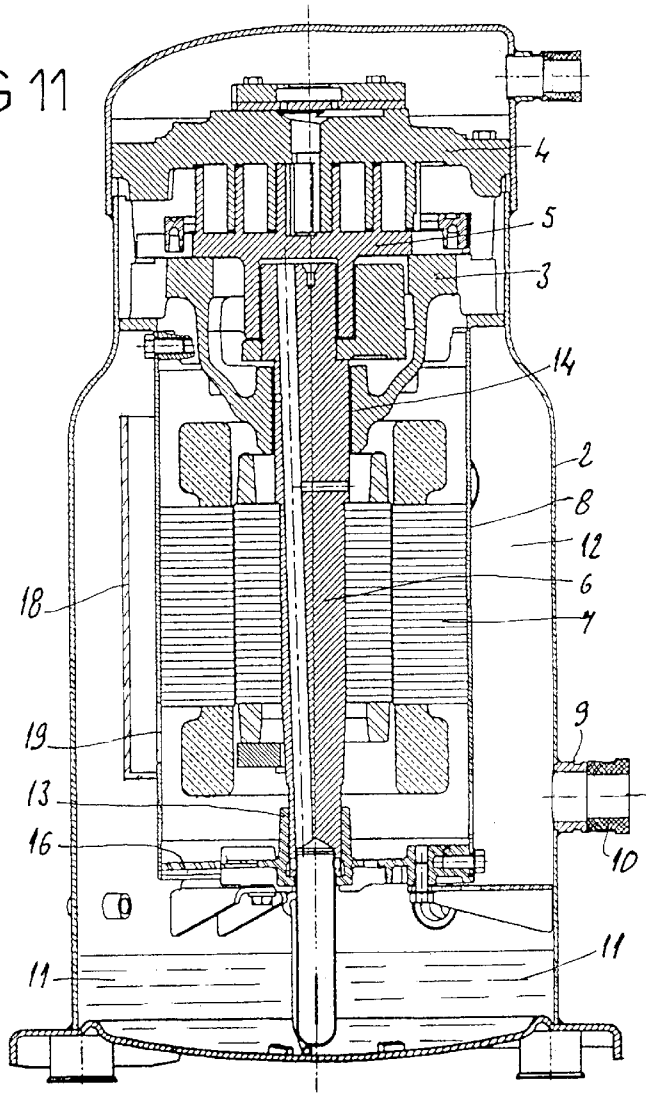
FIG. 11 is a sectional view along a vertical plane and in another plane of the compressor of FIG. 10.
Figure 10:
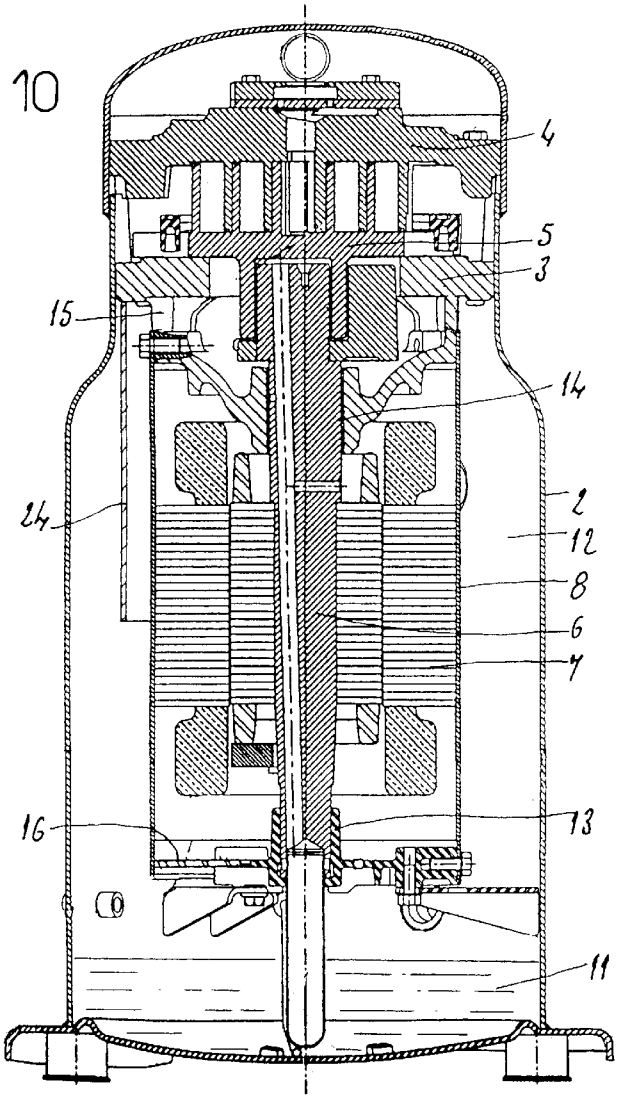
FIG. 10 is a longitudinal secitonal view of a compressor comprising a downwards oil return duct.

In the embodiment depicted in FIGS. 10 and 11, the compressor comprises a downwards oil return duct 24 associated with an oil outlet orifice 15 in the body.

This duct makes it possible to separate the flows of oil and gas and to avoid the constraint of orientating the chimneys 18 with respect to the position of the oil return orifice 15 of the upper bearing. Depending on the position chosen, the return duct 24 will need to have a length suited to the proximity of the intake connection and of the intake chimney 18.

Figure 13:
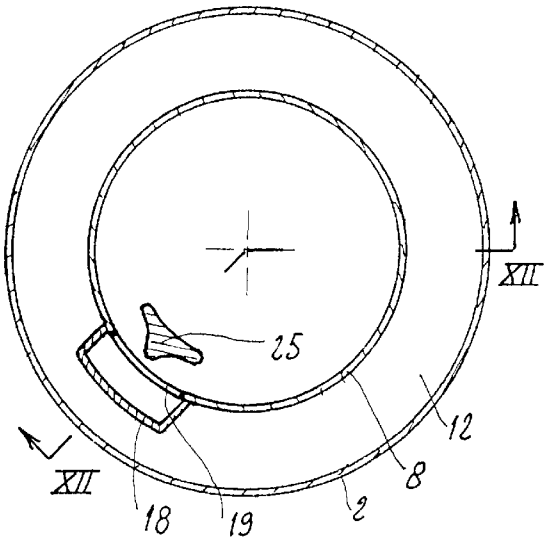
FIG. 13 is a horizontal sectional view of the compressor of FIG. 12.
Figure 12:
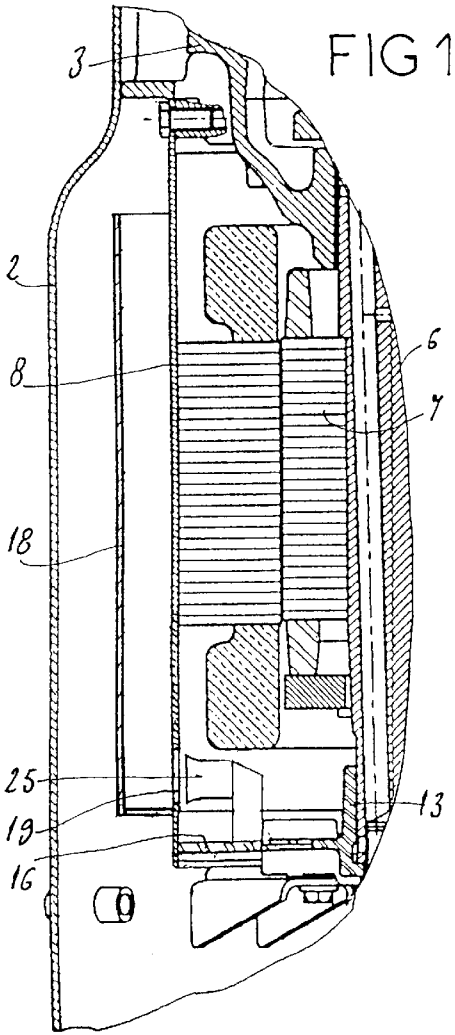
FIG. 12 is a longitudinal sectional view and on a larger scale on the line XII—XII of FIG. 13, of a detail of construction of a compressor.
Figure 16:
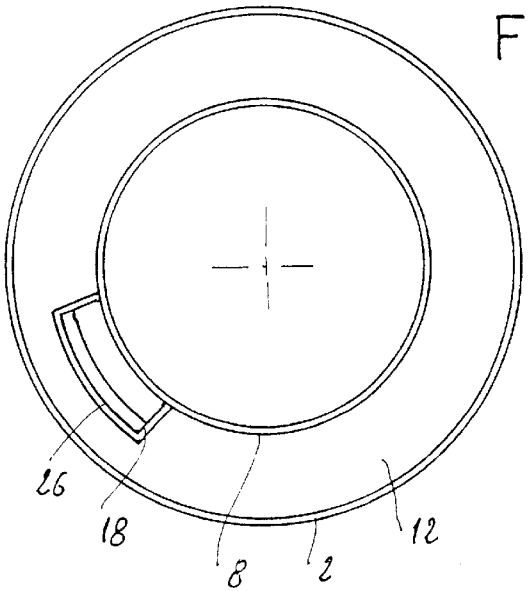
FIG. 16 is a sectional view along a horizontal plane of this same compressor showing the chicane.
Figure 15:
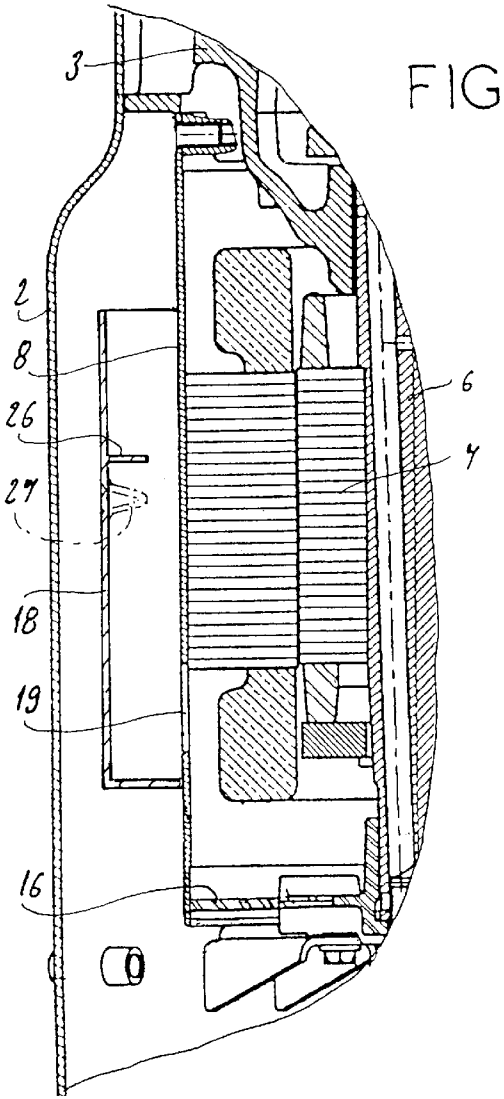
FIG. 15 is a longitudinal sectional part view of another compressor the intake duct of which has a chicane.

FIGS. 12 and 13 reveal the presence of a lower deflector 25 situated in the zone into which the lower end of a chimney 18 opens into the motor compartment. This deflector is aimed at ensuring uniformity of the distribution of the gaseous flow rate through the motor, thus avoiding the introduction of poor cooling of certain parts of the motor windings, as could be the case if there were zones through which the gas preferred to pass.

Figure 14:
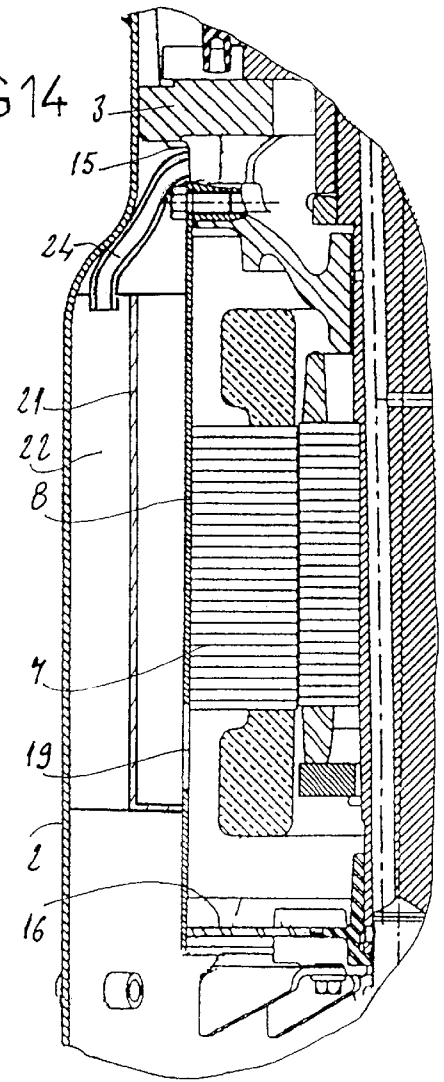
FIG. 14 is a longitudinal sectional part view of a compressor comprising an oil return duct formed with an intake duct of the type depicted in FIG. 6.

FIG. 14 depicts a compressor equipped with an oil return duct 24 associated with a chimney delimited by a profile 21 such as the one depicted in FIG. 6. The oil return duct 24 then passes into the recess 22 formed between the profile 21 and the outer casing of the compressor.

In order to reduce the compressor running noises, each chimney 18 may be equipped with a plate 26 or with one or more boss(es) 27 forming one or more chicane(s).

Figure 18:
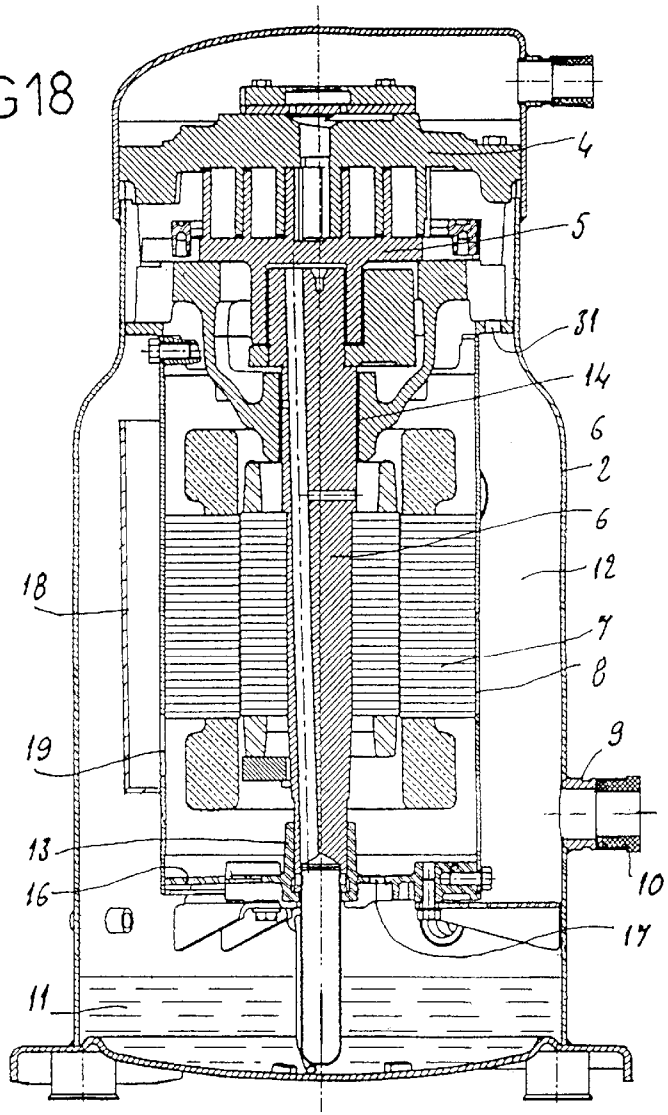
FIG. 18 is a longitudinal sectional view of another alternative form of embodiment in which the compressor comprises one or more bypass duct(s)
Figure 17:
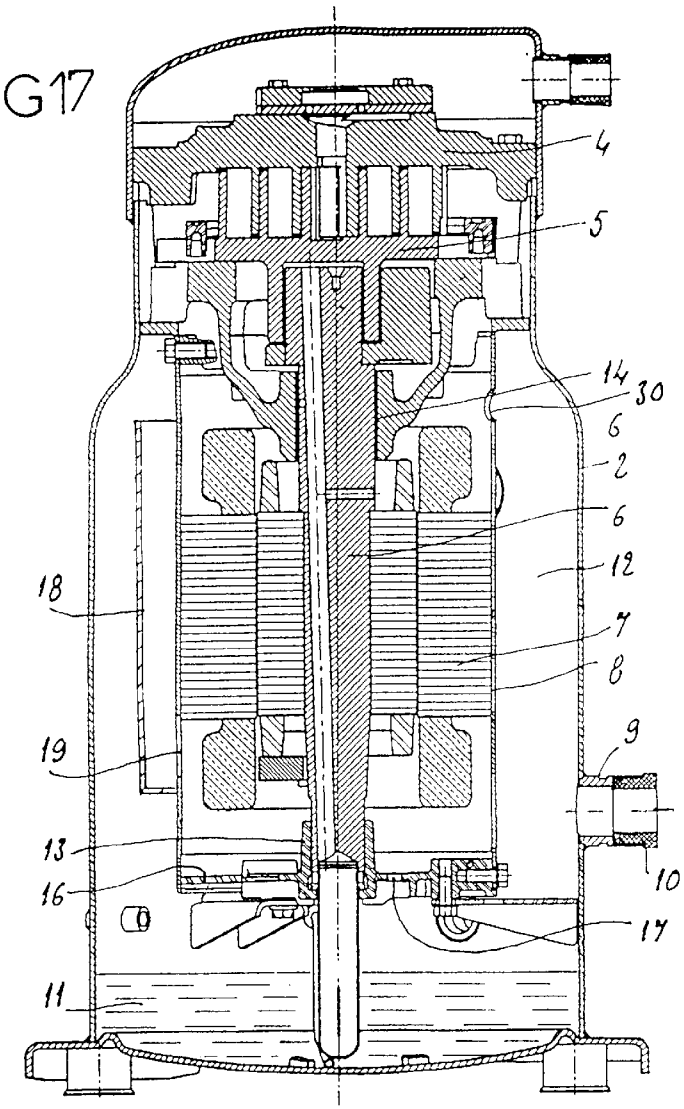
FIG. 17 is a longitudinal sectional view of an alternative form of embodiment in which the compressor comprises one or several bypass duct(s)
Figure 19:
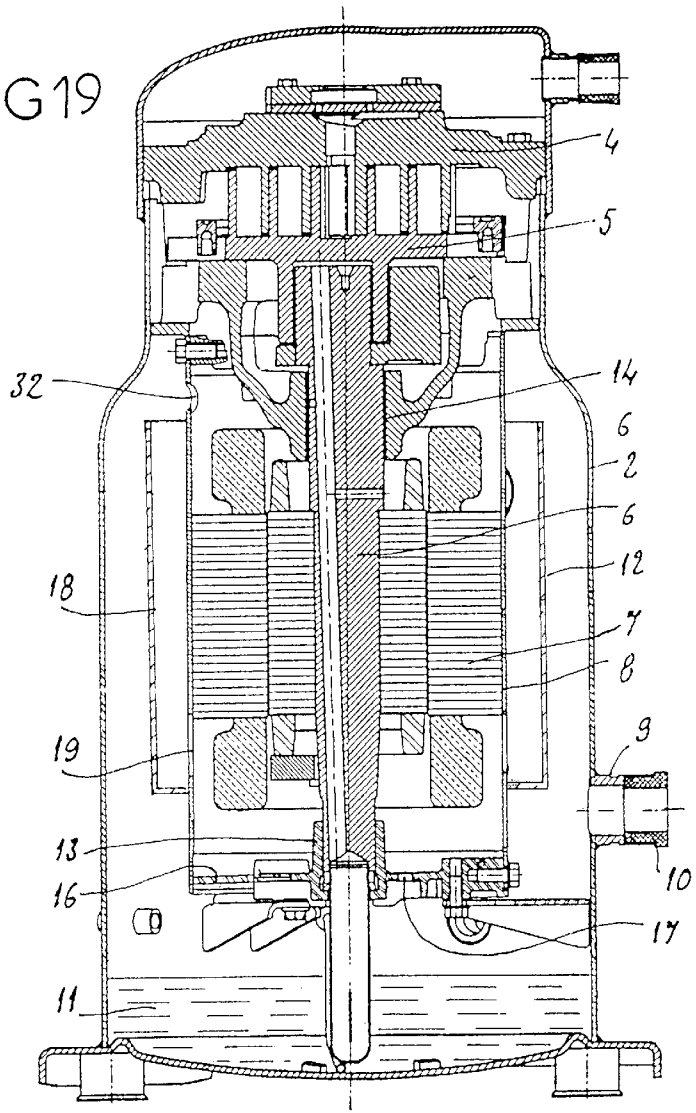
FIG. 19 is a longitudinal sectional view of yet another alternative form of embodiment in which the compressor comprises one or more bypass duct(s)

With a view to improving the performance of the machine by reducing the pressure drops, one or more bypass duct(s) 30, 31, 32 may, as shown in FIGS. 17 to 19, be arranged between the dead volume 12 and the cavity corresponding to the upper part of the motor or in the body. Likewise, increasing the clearance between the circular part of the body 3 and the outer casing 2 will make it possible to achieve this bypass effect.

FIG. 19 shows that the compressor may comprise a chimney in the form of a duct enveloping the compressor drive system and placing the gases drawn in from the low-pressure upper zone of the compressor in communication with the opening or openings allowing the flow of gas to arrive in the lower part of the motor.

Figure 21:
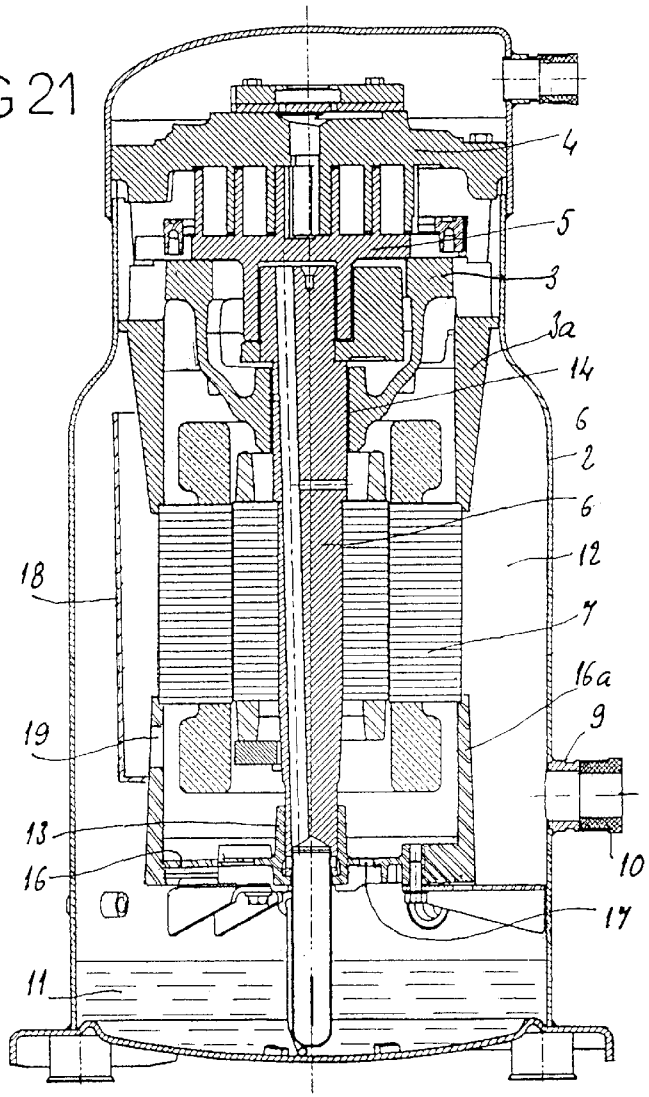
FIGS. 20 and 21 are two sectional views on two vertical planes of another form of embodiment of this compressor.
Figure 20:
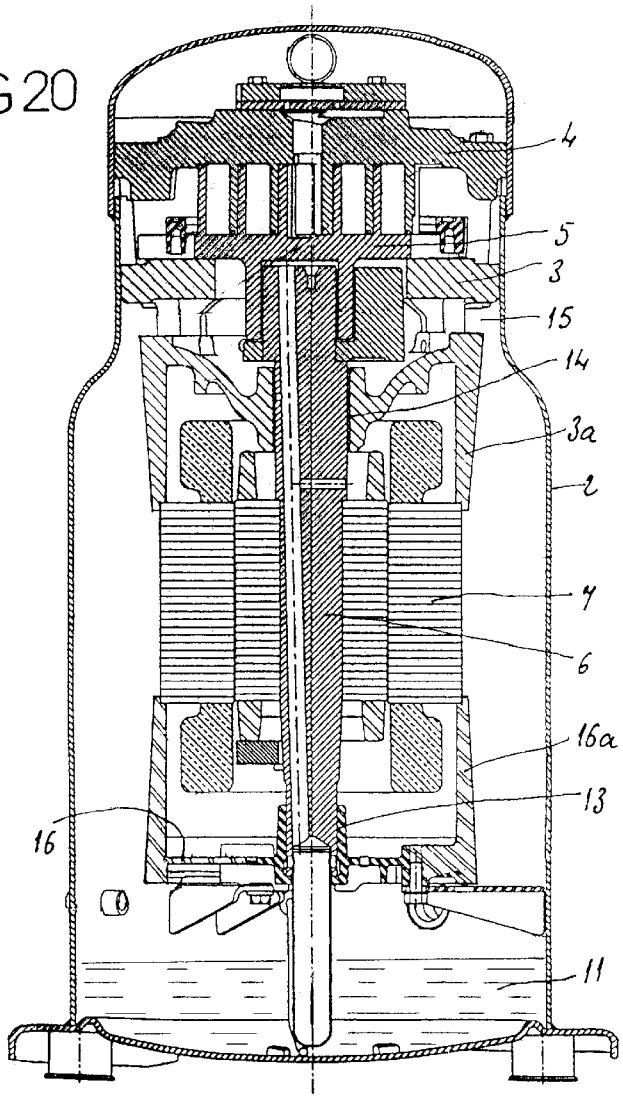

FIGS. 20 and 21 depict another embodiment of a scroll-type compressor, in which embodiment the same elements are denoted by the same references as before. In this case, the body 3 comprises a part 3*a* in the form of a tubular skirt facing downwards and to the lower end of which the motor 7 is fixed. This skirt 3*a* delimits, with the motor, an upper cavity for supplying the compression stage with gas. The lower bearing 13 of the drive shaft is associated with a sealed bottom 16 and with a tubular skirt 16*a* facing upwards, extending as far as the motor 7 and with it delimiting a lower cavity. The gas passes from the lower cavity to the upper cavity, cooling the motor. At least one chimney 18 is arranged substantially vertically along the skirt 3*a*, the motor 7 and the skirt 16*a*, inside the outer casing 2. This chimney 18 communicates, in its upper part, with the low-pressure zone 12 of the compressor and, in its lower part, via an orifice 19 formed in the skirt 16*a*, with the inside of the cavity delimited by the skirt 16*a*.

It goes without saying that the features set out may be applied to compressors having a similar arrangement and using other compression systems, such as a piston-type compressor, a co-rotating compressor, etc.

As is evident from the foregoing, the invention provides a great improvement to the prior art by supplying a scroll-type compressor which, using simple means, distributes the fluids entering the compressor, separating the fluids in the gaseous and liquid states originating from the intake duct, controlling the circulation of oil by separating the streams of gas and the streams of oil, circulating the gas without creating pressure drops between the intake connection and the oil reserve, and reducing the noise level by filtering out compression noises.

What is claimed is:

1. A compressor, comprising:

a sealed outer casing defining a gas compression stage therein;

the compression stage being mounted on a body;

a motor positioned inside the outer casing, for driving the gas compression stage;

the motor being arranged under the compression stage and being coupled to a sealed inner casing;

the outer casing having a gas inlet opening and delimiting, with an assembly comprising of the body, the motor, the inner casing and the compression stage, a low-pressure zone;

the body defining at least one opening for allowing lubricating oil to return to a reservoir delimited by the bottom of the outer casing;

the motor being cooled by gas passing through the motor towards the compression stage;

a lower part of the inner casing containing the motor being sealingly closed by a bottom;

at least one chimney being arranged in an annular space formed between the outer casing and the inner casing, said chimney being arranged substantially vertically along the motor and the inner casing;

the chimney being in communication with the low-pressure zone and with the inside of the inner casing; and wherein one or more openings being defined in the inner casing between the chimney and a bottom part of the motor.

2. A compressor according to claim 1, wherein:

the body comprises a part in the form of a downwardly facing tubular skirt;

the motor being fixed to a lower end of the skirt;

the skirt and the motor cooperating to define a cavity for supplying the compression stage with gas;

a lower bearing comprising a part in the form of an upwardly facing tubular skirt extending as far as the motor and cooperating therewith to define a lower gas inlet cavity at the bottom of the motor, the gas passing from this lower cavity towards the upper cavity, cooling the motor;

the lower part of the inner casing delimited by the upwardly facing skirt and the lower bearing, being closed by a sealed bottom;

at least one chimney arranged substantially vertically along the downwardly facing skirt, the motor, and the upwardly facing skirt, inside the outer casing; and the chimney communicating in its upper part with the low-pressure zone of the compressor and in its lower part with the inside of the cavity delimited by the upwardly facing skirt.

3. A compressor according to claim 1, wherein the chimney communicates in its upper part with the low-pressure zone of the compressor at a location not subjected to the presence of oil.

4. A compressor according to claim 1, wherein each chimney is angularly offset with respect to one of the openings of the body allowing oil to return to a reservoir delimited by the bottom of the outer casing.

5. A compressor according to claim 1, wherein the bottom which closes the inner casing containing the motor has at least one opening for discharging liquid to the reservoir delimited by the bottom of the outer casing.

6. A compressor according to claim 1, wherein at least one opening made in the body and acting as a passage for the oil is extended downwards by a duct opening below the level of an intake opening of each chimney.

7. A compressor according to claim 1, wherein each chimney consists of a profiled plate made of metal or synthetic material, fixed to the inner casing and delimiting a chimney with its outer surface.

8. A compressor according to claim 1, wherein each chimney consists of a profiled plate bearing, on the one hand, against the outer casing and, on the other hand, against the inner casing and delimiting a chimney therewith.

9. A compressor according to claim 1, wherein each chimney consists of a duct fixed to the inner casing.

10. A compressor according to claim 1, further comprising, a deflector positioned inside the inner casing and facing at least one of the openings defined in the inner casing between the chimney and the bottom part of the motor, the deflector for distributing incoming gas in the inner casing.

11. A compressor according to claim 1, wherein each chimney is delimited on the outer casing side by a wall which has a central and longitudinal recess in which a duct for returning oil leaving the body to an oil reservoir delimited by the bottom of the outer casing is engaged on at least one chimney.

12. A compressor according to claim 1, wherein at least one chimney comprises a baffle comprising, a plate or of a boss protruding inwards.

13. A compressor according to claim 1, comprising a chimney in the form of an annular duct enveloping the compressor drive system and placing the gases drawn in from the upper low-pressure zone of the compressor in communication with the opening or openings allowing the flow of gas to reach the lower part of the motor.

14. A compressor according to claim 1, further comprising at least one gas bypass duct between the low-pressure zone and a zone supplying the compression stage with gas.

15. A compressor according to claim 1, further comprising at least one duct for the bypassing of the gases of the low-pressure zone and the upper part of the motor.

16. A compressor according to claim 1, comprising a compression system having a moving scroll and a fixed scroll the relative motion of which is of the orbital type.

17. A compressor according to claim 1, comprising a compression system which has two moving scrolls rotating about offset and parallel axes, and the relative motion of which is of the orbital type.

18. A compressor according to claim 1, comprising a reciprocating-piston-type compression system.

19. A compressor, comprising:

a sealed outer casing defining a gas compression stage therein;

a motor positioned inside the outer casing, for driving the gas compression stage;

the motor dividing an inner volume of an inner casing into an upper part which defines an upper cavity for supplying the compression stage with gas and a lower part which defines a lower gas inlet cavity at a bottom portion of the motor, gas flowing between the lower cavity and the upper cavity aids in cooling the motor;

the outer casing comprising a gas inlet opening and delimiting, with the inner casing and a body of the compression stage, a low-pressure zone;

the body defining at least one opening for allowing lubricating oil to return to a reservoir delimited by the bottom of the outer casing;

the lower part of the inner casing being sealingly closed by a bottom;

at least one chimney being arranged in an annular space formed between the outer casing and the inner casing, the chimney being arranged substantially vertically along the inner casing and communicating in its upper part with the low-pressure zone of the compressor and in its lower part with the inside of the inner casing.

* * * * *